United States Patent [19]

Milburn

[11] Patent Number: 4,974,789

[45] Date of Patent: Dec. 4, 1990

[54] DISPENSING PACKAGE FOR A FIBER-OPTIC DEVICE

[75] Inventor: James A. Milburn, Santa Ana, Calif.

[73] Assignee: Trimedyne Laser Systems, Inc., Tustin, Calif.

[21] Appl. No.: 374,243

[22] Filed: Jun. 29, 1989

[51] Int. Cl.[5] ..... B65H 55/00

[52] U.S. Cl. ..... 242/159; 206/409; 206/438; 242/129; 242/137.1; 242/146; 242/171

[58] Field of Search ..... 242/159, 166, 167, 170, 242/171, 129, 96, 85, 85.1, 1, 137, 137.1, 141, 146; 206/409, 438, 439, 63.3

[56] References Cited

U.S. PATENT DOCUMENTS

| | | | |
|---|---|---|---|
| 3,185,299 | 5/1965 | Trainer | 206/63.3 |
| 3,301,393 | 1/1967 | Regan, Jr. et al | 206/409 |
| 3,352,412 | 11/1967 | Draving et al. | 242/159 X |
| 3,495,703 | 2/1970 | Calabrese | 242/129 X |
| 3,727,858 | 4/1973 | Cornwell et al. | 242/129 |
| 4,685,636 | 8/1987 | Eaton | 242/129 |
| 4,846,343 | 7/1989 | Rupert | 242/129 X |

*Primary Examiner*—Stanley N. Gilreath
*Attorney, Agent, or Firm*—Baker & McKenzie

[57] ABSTRACT

A dispensing package for a fiber-optic cable comprised of two mating members and a separator disposed therebetween. The two mating members have centrally located openings and are joined at their mating edges and define a cavity therebetween. The separator is secured between the mating members to divide the cavity into first and second cable receiving chamber. Each cable receiving chamber accommodates a circularly coiled cable portion. A fiber-optic cable passes through the separator and opposite cable ends exit respectively from the central apertures of each mating member to allow cable to be payed out from opposite sides of the package. A series of apertures in the mating members and separator define a plurality of flow passages through the package for sterilization purposes.

16 Claims, 1 Drawing Sheet

DISPENSING PACKAGE FOR A FIBER-OPTIC DEVICE

FIELD OF THE INVENTION

The present invention relates to a package for storing, shielding, and dispensing a fiber-optic device of the type used in human medicine for transferring laser energy.

BACKGROUND OF THE INVENTION

Laser technology is making rapid advances in heart disease treatment. Lasers have been used to clear clogged heart arteries during coronary bypass operations. Direct laser energy has been used point-blank during bypass surgery. Lasers have also been used for treating a more common problem, clogging of the arteries that feed the heart muscle itself.

One laser system involves controlled delivery of laser energy through a fiber-optic cable threaded through a patient's leg and up to the narrowed heart vessel. A metal tip or probe at the distal tip of the fiber-optic cable is heated by the laser energy passing through the fiber-optic cable. The temperature of the probe is controlled by the amount of laser energy delivered thereto. As such, there is controlled thermal delivery of laser energy without the direct application of laser energy to unrelated tissue. Instead, tissue effects are limited to the surface immediately surrounding the area of contact with the probe, and the area to be treated. Thus, there is a predictable, controlled, and uniform tissue effect.

An essential element in this system is the fiber-optic cable that is used to deliver laser energy to the probe. The fiber-optic cable consists essentially of a relatively thin flexible cable, up to five meters in length. Such a fiber-optic cable is fragile, is easily abused, and is difficult to store because of its bias toward a straight line in a relaxed position.

Because of its delicate characteristics, packaging for such a fiber-optic cable must protect the full length of the cable against damage. Such packaging for a fiber-optic cable should also meet the following criteria. Any container or dispenser for a fiber-optic cable should hold a coil of fiber-optic cable in the largest diameter possible while fitting into a conventionally dimensioned chevron pouch. Such a package must allow all of the cable to be completely withdrawn, tangle free, from either side of the package. After installing a probe or connector on a cable end, either end of the fiber-optic cable must be easily replaceable into the package for storage for future use and without causing entanglement. Because of its medical usage, the cable package, along with the cable therein, must be easily and completely sterilizable as in a suitable sterilized bath or atmosphere. Additionally, the package should be easy to use and understand.

SUMMARY OF THE INVENTION

In view of the above, and in accordance with the present invention, there is provided an apparatus and method for storing a thin, elongated flexible fiber-optic cable within a package while facilitating complete withdrawal of the cable from either side of the package. The package of the present invention shields the cable against damage yet allows sterilization of the package and cable stored therewithin.

Basically, the dispensing package of the present invention includes three interconnected members. Two members are substantially circular and are joined at the peripheral edges. The two members have a pair of spaced apart side walls defining an internal cavity therebetween. The sidewall of each member further defines a generally centrally disposed opening through which a cable and protrudes. The third member is a separator which is disposed between the other two members for dividing the cavity into first and second cable receiving chambers. Each chamber is adapted to accommodate a portion of cable preferably in a coiled fashion. The separator defines an opening which is generally aligned with the central openings in the other two members and through which a portion of the cable crosses from one chamber to another in a manner allowing the entire length of cable to be payed out from either side of the package.

In a preferred form, the two mating members are substantially identical in form. Each member has a generally circular configuration which allows the package to readily adapt to a conventionally shaped and dimensioned chevron pouch.

To promote sterilization of the package with the cable coiled therein, the members defining the package are configured to define a series of passages extending through the package to allow sterilization gases to reach the cable stored therewithin. In a preferred form, each outer mating member defines a series of circular spaced apart apertures, the apertures in one member being substantially aligned with the apertures in the other member. Each aperture is equidistantly spaced from a common center which is located generally centrally of the members. The diameter of each of the apertures is greater than the spacing between immediately adjacent apertures. In a similar manner, the separator defines a series of circular spaced apart apertures. Each aperture in the separator is equidistantly spaced from a common center which is located generally centrally of the separator. The diameter of the apertures in the separator is greater than the spacing between immediately adjacent apertures. While the respective apertures in the mating members are substantially aligned with each other, the apertures in the separator are angularly offset with respect to the apertures defined by the outer mating members. As such, a series of flow passages extending through, and facilitating sterilization of, the package are provided.

The sidewalls of the mating members are spaced apart such that the internal cavity defined therebetween is slightly wider than two times the width of the cable. When the separator is positioned within the cavity, the chambers defined thereby are sufficiently wide enough to prevent the cable from winding upon itself in preventing entanglement of the cable.

In a preferred form, the package further includes a slotted ring which extends outwardly from the side of at least one of the members for automatically engaging and holding a respective portion of a cable protruding from the package. The ring is slotted so as to releasably hold a portion of the cable extending outwardly from the side of the package.

The present invention provides a solution to the medical industry's need and desire for a fiber-optic cable package. The package of the present invention stores and protects the fragile and easily abused fiber-optic cable in two separate coil receiving chambers. The entirety of the cable can be withdrawn, untangled, from the package. The package allows reinsertion of the cable ends into the package from either side thereof.

Moreover, the package of the present invention lends itself to chemical, gas, or heat sterilization procedures for the cable coiled therein.

Other features and advantages of the present invention will become readily apparent from the following detailed description, appended drawings, and accompanying claims.

DETAILED DESCRIPTION OF A PREFERRED EMBODIMENT

Figure 1:
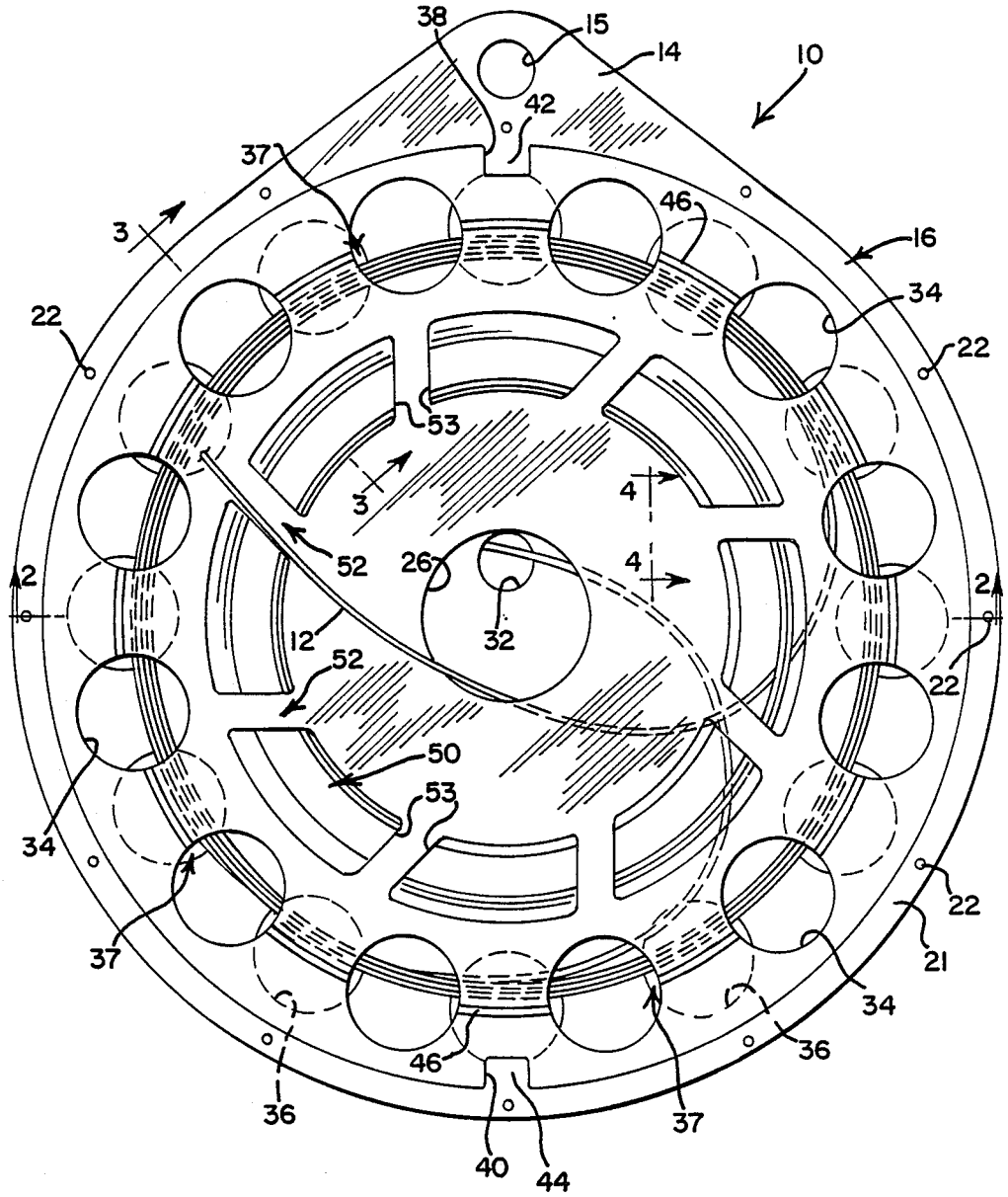
FIG. 1 is a front elevational view of a fiber-optic cable package according to the present invention and with a fiber-optic cable wound therein.

While the present invention is susceptible of embodiment in various forms, there is shown in the drawings a presently preferred embodiment hereinafter described, with the understanding that the present disclosure is to be considered as an exemplification of the invention, and is not intended to limit the invention to the specific embodiment illustrated.

Referring now to the drawings, wherein like reference numerals indicate like parts throughout the several views, there is shown a dispensing package 10 for a fiber-optic cable 12. The fiber-optic cable 12 is essentially a relatively thin flexible conduit ranging in length from about five to seven meters and having a bias toward a straight line in a relaxed or unrestrained position. The cable may be from 300 to 600 microns or more in diameter. The cable is of a known construction and is, of course, sufficiently flexible for use in being threaded through various body openings. It can be readily coiled for storage.

As presently preferred, the cable dispensing package 10 has a generally circular configuration which lends itself for use with a conventionally sized and dimensioned chevron pouch (not shown). For facilitating mounting and storage of the package 10 in a generally vertical orientation, package 10 includes a projecting ear portion 14 defining a suspension opening 15 and which is preferably formed as an integral part of package 10. It should be appreciated, however, that the general configuration of the package 10 can be altered without detracting from the principles of the present invention which are hereinafter described in detail.

Figure 2:
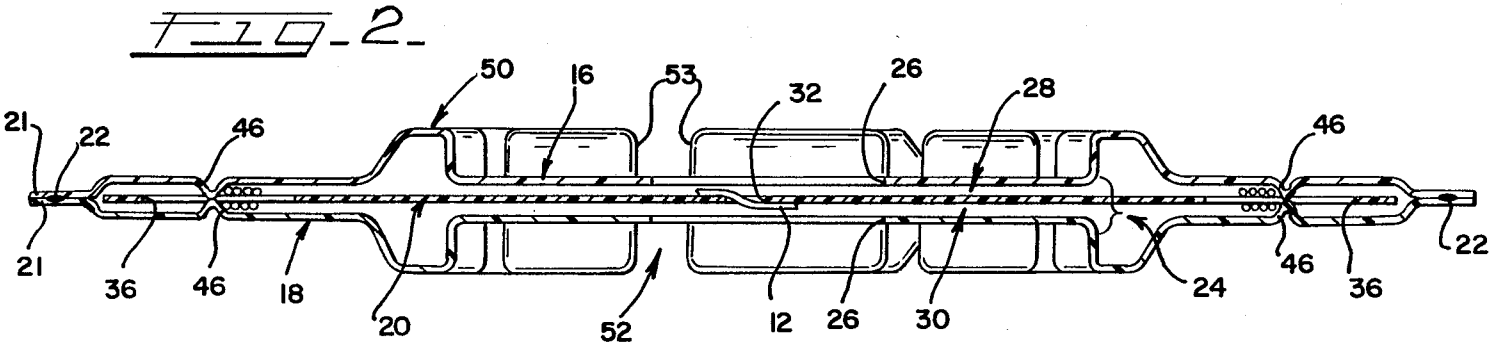
FIG. 2 is a cross sectional view taken along plane 2—2 of FIG. 1.
Figure 4:
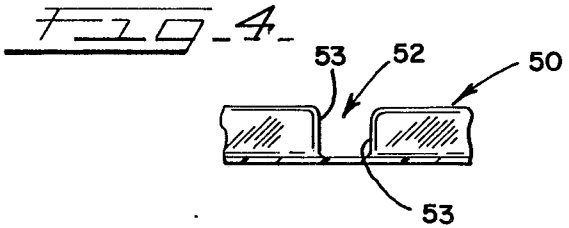
FIG. 4 is a fragmentary side elevational view taken along plane 4—4 of FIG. 1.

As illustrated in FIG. 2, cable package 10 preferably comprises two mating members 16 and 18 with a separator 20 disposed and secured between the members. In this embodiment, the two members 16, 18 are substantially identical. Therefore, any description hereinafter of one member will also pertain to the other member.

Each member preferably is made of a suitable, lightweight, relatively rigid chemically inert plastic material. As illustrated in FIG. 2, each member defines a sidewall which is arranged in a spaced apart confronting relation relative to the sidewall of the other member. The periphery of each member is provided with a flanged edge 21 which is fastened to a mating flanged edge 21 of the other mating member. Preferably, the members 16, 18 are fastened together as by heat sealing the flanged edges 21 together at generally equally spaced peripheral locations such as at twelve such locations generally identified by reference numeral 22 (FIG. 1).

Radially inward from their secured flanged edges, the sidewalls of the members 16, 18 are spaced apart a distance slightly greater than twice the thickness of fiber-optic cable 12 and define a relatively large annular opening or cavity 24. Each member further defines a centrally disposed opening 26 which opens to cavity 24.

The divider or separator 20 is also constructed of a chemically inert plastic. Divider 20 serves to divide cavity 24 into first and second cable receiving chambers 28 and 30 each of which is adapted to accommodate one portion of cable 12 coiled in circular form. Divider 20 defines a relatively small crossover opening 32 which is generally aligned with the openings 26 in each member 16, 18. For reasons to be discussed hereinafter, a peripheral edge of opening 32 is off center and is preferably tangentially arranged relative to a peripheral edge of openings 26 in mating members 16 and 18.

Returning to FIG. 1, each member 16, 18 defines a series of circular and spaced apart apertures 34. Apertures 34 defined by member 16 are generally equally spaced from each other and are in substantial alignment with the apertures 34 defined by member 18. Moreover, the apertures 34 defined in members 16, 18 are equidistantly spaced from a common center located generally centrally of members 16, 18. In the preferred embodiment, each aperture 34 measures about one inch in diameter and is spaced from an immediately adjacent aperture by about $\frac{3}{4}$ of an inch.

Separator 20 also defines a series of circular apertures 36 which are generally equally spaced apart from each other. Each aperture 36 is equidistantly spaced from a common center located generally centrally of members 16, 18. As illustrated, apertures 34 defined by members 16, 18 and apertures 36 defined by member 20 have like lines-of-centers but are misaligned or angularly offset with respect to each other. In the preferred embodiment, each aperture 36 measures about one inch in diameter and is spaced from an immediately adjacent apertures by about $\frac{3}{4}$ of an inch. As such, apertures 34 and 36 combine to define a series of flow passages 37 through the package 10.

As illustrated, separator 20 defines two diametrically opposed radial slots 38 and 40. Locating tabs 42 and 44 provided on the members 16 and 18 fit between slots 38 and 40, respectively, to secure divider 20 against rotation within cavity 24 in a manner maintaining misalignment between apertures 34 and 36 so as to define flow passages 37.

To promote a circularly coiled arrangement of a portion of a fiber-optic cable 12 within each of the chambers 28 and 30, each member 16 and 18 defines inwardly directed and circularly arranged segmental projections 46. As illustrated, projections 46 serve as a seat for the wound cable 12, as is best seen in FIG. 1. As illustrated in FIG. 2, projections 46 extend toward the divider 20 and define an annular seat in each cable receiving chamber. The projections 46 are preferably arranged centrally of the apertures 34 of each mating member and depend through the apertures 36 defined by divider 20. Thus the projections 46 on member 16 are positioned relative to and confront in an abutting relation the projections on member 18.

As illustrated in FIG. 2, an annular slotted or notched ring 50 is provided on each member 16, 18. They are concentric and extend outwardly from a sidewall of each mating member, between the projections 46 and the central opening 26. Preferably, ring 50 is formed as an integral part of each member 16, 18. Each ring 50 defines a plurality of uniformly spaced, non-radial slots 52. Each slot 52 has generally parallel side surfaces 53. A line between and parallel to the side surfaces 53 of each slot lies generally tangential to an edge of the central opening 26 in the respective member. The slots 52 in the rings 50 automatically engage and releasably hold a respective portion of cable protruding from the central opening in the package.

Figure 5:
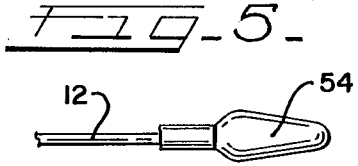
FIG. 5 is a schematic representation of a typical probe connected to a distal end of the fiber-optic cable.
Figure 3:
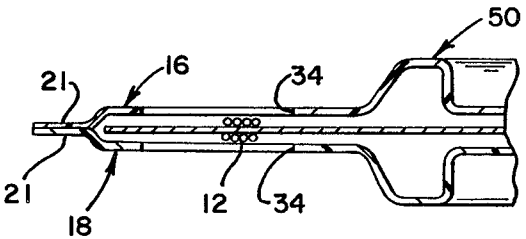
FIG. 3 is a fragmentary sectional view taken along plane 3—3 of FIG. 1.

Turning to FIG. 5, a probe tip 54 is connected to one end of the fiber-optic cable 12. When the cable 12 is wound within package 10, a portion of cable with the probe tip secured thereto protrudes from a central opening 26 in the package. The slots 52 in each ring 50 are configured to releasably hold the probe tip 54 for ready access to the user thereof.

To store cable 12 within the package 10, one end of the fiber-optic cable 12 is passed through opening 26 in member 16, aperture 32 in separator 20, and through opening 26 in member 18. As such, one portion of cable 12 extends from opening 32 in separator 20 and a second portion of cable 12 extends from opening 32 on the opposite side of separator 20. Preferably, and although not necessarily required, the cable portions extending from opposite sides of separator 20 are substantially equal in length.

For purposes of this description, it will be assumed that a portion of cable 12 is first to be wound within chamber 28 of package 10. After passing cable 12 through the package 10, that portion of cable passing outwardly from chamber 28 and adjacent opening 32 is forced into a small loop segment having a diameter just slightly less than the opening 26 in member 16. In the preferred embodiment, opening 26 is about 1.5 inches in diameter. Notably, the diameter of opening 26 is sized to prevent crimping of the cable when it forms the loop segment for insertion into opening 26. Positioning of the opening 32 tangential to opening 26 permits a slightly larger loop to be formed and reduces the possibility of cable crimping.

To facilitate forming a loop in the cable, the cable portion on the opposite side of separator 20 in the region of aperture 32 is pressed against separator 20 to provide a braking force which retards additional cable from being introduced into the loop from the opposite side of separator 20. The looped segment of the cable is then passed through opening 26 and slid under the sidewall of member 16 and is pushed inwardly and allowed to expand to its effective diameter. Subsequent gentle pushing on the cable toward the projections 46 causes the loop to automatically move outwardly toward the seat defined by projections 46. It will be appreciated that the natural tendency in the cable toward a straight line expands the loop outwardly and naturally holds the cable against the seat. As the cable is fed into the chamber, the cable coils inwardly to form convolutions of coils within the chamber. The restricted spacing between the separator 20 and the respective member at the outer reaches of the chamber prevents the cable from entangling with itself. The cable is wound until a predetermined length of cable extends laterally out from the package 10 through the central opening 26 for access to the user thereof.

Notably, the circular edge of opening 32 provides a sliding resistance to the cable 12 during winding thereof into the respective chamber. As such, the lengths of cable on each side of separator 20 remain substantially as chosen prior to cable winding. It has been observed that the tangential relationship of opening 32 in separator 20 relative to the opening 26 in members 16, 18 also minimizes the problem of the cable loop from crossing under itself while being wound in a cable receiving chamber.

The remainder of cable 12 is wound in the other chamber in a substantially similar manner. Again, the other cable portion is wound until a predetermined length of cable extends laterally outward from the package through the central opening 26 for access to the user thereof.

From the above, it will be appreciated that opposite ends of the fiber-optic cable extend from opposite sides of package 10. As will be appreciated, package 10 will allow the fiber-optic cable to be completely removed, tangle free, from either side of the package. Moreover, either end of the fiber-optic cable is replaceable into the package after being removed therefrom.

Because the cable is used for insertion into the human body, the package and cable coil therein must be capable of withstanding sterilization techniques. By forming the members 16, 18 and 20 from a chemically inert plastic material, the entire package 10, with the cable stored therein, can be placed in a suitable sterilizing bath or atmosphere. Since the seat against which the cable is wound is aligned with the apertures 34, 36 extending through the package, sterilization of the fiber-optic cable in insured. Because all internal portions of the package are open to the passage of gases therethrough, as through openings 34 and flow passages 37, sterilization of the fiber-optic cable is insured. Furthermore, because the fiber-optic cable is wound or coiled inside of the members, the cable is protected against damage from objects which may strike or impinge against the package 10. Moreover, the free ends of the cable are automatically engaged and are secured by the slotted ring 50 so as to prevent them from entanglement.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A dispensing package for storing a thin, elongated flexible fiber-optic cable therewithin while facilitating complete withdrawal of the cable from either side of the package, said dispensing package comprising:

two mating members joined at their peripheral edges, each defining a sidewall, said sidewalls being spaced apart and defining an internal cavity therebetween, the sidewall of each mating member further defining a generally centrally disposed opening through which an end of the cable protrudes from said cavity; and a separator disposed between said mating members for dividing said cavity into first and second cable receiving chambers, with each chamber being adapted to store a portion of said cable, said separator defining an opening generally aligned with the central openings in said mating members and through which a portion of said cable crosses to allow the entire length of cable to be payed out from either or both sides of the package.

2. The dispensing package according to claim 1, wherein said package further includes means disposed within each of said cable receiving chambers for arranging a cable portion in an annular coiled configuration which allows the entire cable to be withdrawn from said package in an untangled manner.

3. The dispensing package according to claim 1, wherein said sidewalls of said members are spaced apart such that the internal cavity is slightly wider than two times the width of said cable.

4. The dispensing package according to claim 1 wherein said mating members and separator are configured to define a series of passages extending through the package to facilitate sterilization of the package and the cable stored therewithin.

5. The dispensing package according to claim 1, further including means extending outwardly from at least one sidewall of a mating member for automatically engaging and holding a respective portion of cable protruding from said package.

6. A dispensing package for storing a thin, elongated flexible fiber-optic cable therewithin and such that the cable can be completely withdrawn untangled from either side of the package with minimum resistance, said dispensing package comprising:

two substantially circular members each defining a generally central opening through which a cable end protrudes, said members being joined at their peripheral edges and being in a spaced apart confronting relation radially inwardly of their peripheral edges to define an internal substantially circular cavity therebetween; and separation means disposed and secured between said mating members for dividing said cavity into first and second cable receiving chambers with each chamber being adapted to accommodate a portion of said cable in a coiled configuration, said separation means defining an opening generally aligned with the central openings in said members and through which a portion of said cable crosses from chamber to another and in a manner allowing the entire length of cable to be payed out from either side of the package.

7. The dispensing package according to claim 6, wherein each member defines a series of circular spaced apart apertures, the apertures in one member being substantially aligned with the apertures in the other member, and wherein each aperture is equidistantly spaced from a common center located generally centrally of said members, said apertures facilitating sterilization of said package and the cable stored therewithin.

8. The dispensing package according to claim 7, wherein the diameter of each of said apertures is greater than the spacing between immediately adjacent apertures.

9. The dispensing package according to claim 7, wherein said separation means defines a series of circular and spaced apart apertures, and wherein each aperture in said separation means is equidistantly spaced from a common center located generally centrally of said separation means, said apertures facilitating sterilization of said package and the cable stored therewithin.

10. The dispensing package according to claim 9, wherein the diameter of each of said apertures is greater than the spacing between immediately adjacent apertures.

11. The dispensing package according to claim 6, wherein each member defines a series of circular spaced apart apertures, each aperture in said members being equidistantly spaced from a common center located generally centrally of said members, and wherein said separation means defines a series of circular spaced apart apertures, the apertures defined by said separation means being located on a common line-of-centers with the apertures defined by said members, the respective apertures in said members being substantially aligned with each other and the apertures in said separation means being angularly offset with respect to the apertures defined by said members, to define a series of flow passages extending through, and facilitating sterilization of, said package.

12. The dispensing package according to claim 11 further including means for preventing radial displacement of said separation means relative to either of said members.

13. The dispensing package according to claim 6, wherein each member further includes a slotted ring which projects outwardly from each member for automatically engaging and holding a respective portion of cable protruding from said package.

14. The dispensing package according to claim 13, wherein each ring is integrally formed with the member from which it outwardly projects.

15. The dispensing package according to claim 13, wherein said members are substantially identical and are formed from a heat sealable material.

16. A method for storing a flexible cable within a package in a manner allowing the entire cable to be withdrawn untangled and with minimal resistance from either side thereof, said package defining a circular accumulation cavity opening to opposite sides of said package and including a separator between the sides of said package for dividing the circular accumulation cavity into two side-by-side chambers, said separator defining an aperture which permits an end of said cable to be passed through said separator;

said method comprising the steps of:

passing one end of said cable through the aperture in said separator such that a first portion of cable is situated on one side of said separator and a second portion of cable is situated on the opposite side of said separator; and forming at least one coiled cable wrap from at least one portion of said cable within at least one of said chambers while allowing terminal ends of said cable to pass from opposite sides of said package for subsequent ready removal of said cable from each side of said package.

* * * * *